United States Patent [19]

Tuckman

[11] Patent Number: 4,690,579

[45] Date of Patent: Sep. 1, 1987

[54] BRUSH EXTENSION DEVICE

[76] Inventor: Drew E. Tuckman, 25-15 Fair Lawn Ave., Fair Lawn, N.J. 07410

[21] Appl. No.: 772,012

[22] Filed: Sep. 3, 1985

[51] Int. Cl.[4] ..... A45D 34/00; A46B 11/00

[52] U.S. Cl. ..... 401/127; 141/24; 401/129

[58] Field of Search ..... 401/126, 127, 129, 99, 401/184, 185; 141/24

[56] References Cited

U.S. PATENT DOCUMENTS

| | | | |
|---|---|---|---|
| 66,213 | 7/1867 | Burnett . | |
| 342,206 | 5/1886 | Hudnett . | |
| 531,133 | 12/1894 | Pomeroy | 141/24 |
| 816,481 | 3/1906 | Lane | 401/129 |
| 2,005,091 | 6/1935 | Kuenstler | 401/185 X |
| 2,125,957 | 8/1938 | Sager | 401/185 |
| 2,756,749 | 7/1956 | Munday | 141/24 |
| 3,337,901 | 8/1967 | Schefer et al. . | |
| 3,694,096 | 9/1972 | Seidler . | |
| 4,313,686 | 2/1982 | Proffer . | |
| 4,376,591 | 3/1983 | Proffer . | |
| 4,475,834 | 10/1984 | Bean | 401/99 |

FOREIGN PATENT DOCUMENTS

| | | | |
|---|---|---|---|
| 823417 | 12/1951 | Fed. Rep. of Germany . | |
| 3000411 | 7/1981 | Fed. Rep. of Germany . | |
| 1395217 | 3/1965 | France | 401/129 |
| 200973 | 9/1969 | France | 401/184 |
| 442641 | 1/1968 | Switzerland | 401/127 |

*Primary Examiner*—Steven A. Bratlie

*Attorney, Agent, or Firm*—Edward R. Weingram

[57] ABSTRACT

An inflatable bladder and extendable diaphragm are affixed within the cap of a standard liquid container. The shaft and brush for removing the liquid from the container are attached to the diaphragm portion. The bladder can be compressed in a variety of ways manually and thereby causing the diaphragm portion to extend, moving the shaft and liquid pick-up means so that the liquid at the bottom of the container can be easily removed.

11 Claims, 6 Drawing Figures

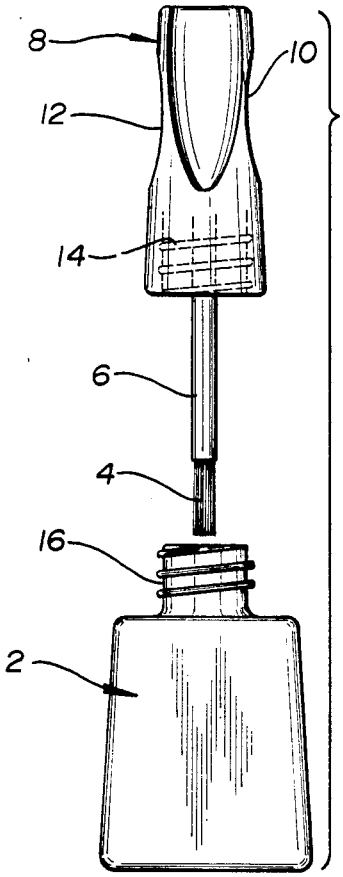
FIG-1
FIG-2
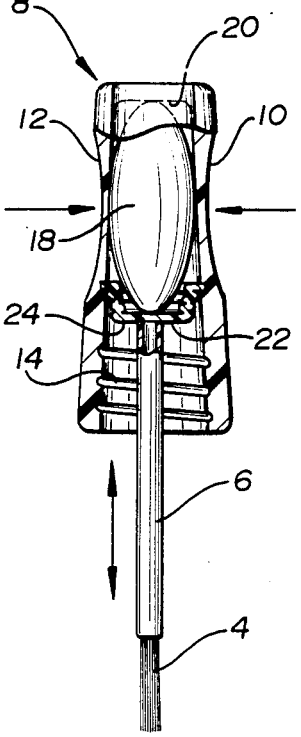
FIG-5
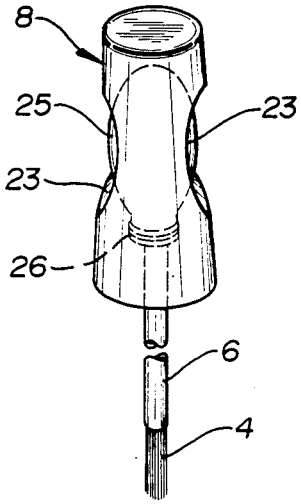
FIG-3
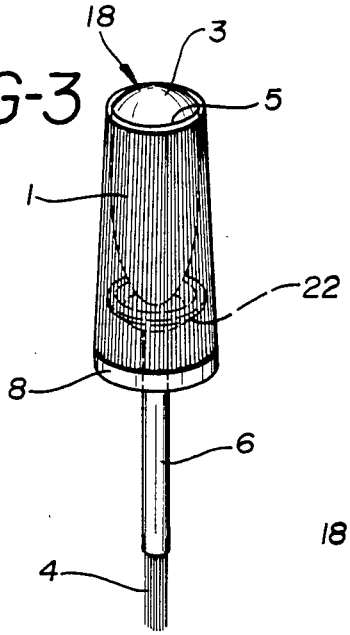
FIG-4
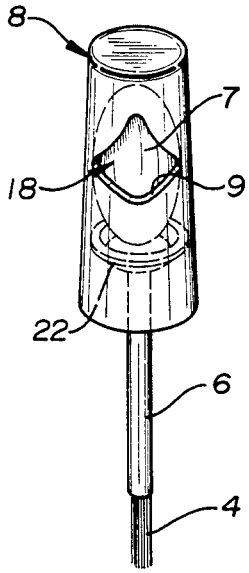
FIG-6
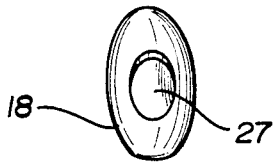

BRUSH EXTENSION DEVICE

BACKGROUND OF THE INVENTION

1. Field of the Invention

This invention relates to a simple device for enabling a brush to extend so that the contents at the bottom of a bottle or other container can be reached.

2. Description of the Prior Art

In the everday nail polish bottle, the problem is noted in reaching nail polish at the bottom of the bottle with the brush built into the handle. This is difficult and requires the bottle to be either tilted or otherwise manipulated. The present invention provides a simple way of extending the brush to reach the liquid and all corners at the bottom of the nail polish bottle. Of course, the invention is applicable to other containers for other liquid as well.

The invention consists of a nail polish cap which has incorporated therein a gas-filled chamber to which a flexible diaphragm is attached. The brush is attached to the diaphragm. When the chamber is squeezed, the brush is extended for the length of the diaphragm.

The problems associated with the prior art dispensing containers utilizing the brush are discussed in greater detail in U.S. Pat. No. 3,337,901. That patent proposed a complex solution to the problem involving a spring-loaded brush applicator including a hollow barrel retractibly extending into a closure cap. Other devices of the prior art include the holders of U.S. Pat. Nos. 66,213; 342,206; 3,694,096; 4,313,686; and 4,376,591. In addition, devices for obtaining an extension of the brush are shown in German Pat. Nos. 3,000,411 and 823,417. The main problem with most of the prior art solutions to the problem is their complexity and attendant cost. Many of the prior art devices incorporate spring and other mechanics to lock and unlock the cap to the bottle while maintaining or extending the brush portion. These solutions are costly to manufacture and, when one considers the number of such containers involved, it is not economically justifiable to commercialize these developments.

Other devices in the prior art such as shown in U.S. Pat. No. 66,213 and the German Pat. No. 823,417 involve sliding the handle within an aperture in the closure cap. The friction fit of the aperture walls against the handle gives the necessary support. The brush is attached to the handle and thereby adjustment of the position of the handle in the cap assures the desired brush position.

The problem with these prior art devices is their tendency to clog and seal as the nail polish or other liquid hardens and portions of the liquid adhere to the sliding handle or spring mechanisms. It is also noted that a friction fit tends to unseal with time, causing hardening of the liquid in the container by exposure to air.

Applicant's invention overcomes the disadvantages of both of the prior art approaches.

SUMMARY OF THE INVENTION

An inflatable bladder and extendable diaphragm are affixed within the cap of a standard liquid container. The shaft and brush for removing the liquid from the container are attached to the diaphragm portion. The bladder can be compressed in a variety of ways manually and thereby causing the diaphragm portion to extend, moving the shaft and liquid pick-up means so that the liquid at the bottom of the container can be easily removed.

Accordingly, it is an object of this invention to provide a cap for a container which includes an applicator shank which can extend down to the bottom of the interior of the container as desired by simply squeezing the top of the cap to obtain the momentary desired extension of the applicator.

Yet another object of the present invention is to incorporate an air-filled diaphragm in the cap of an applicator for use with a container of liquid where the air filled diaphragm is attached to the shank of the applicator and whereby a momentarily squeezing of the diaphragm produces an extension of the shank and thereby the applicator.

Still another object of this invention is to provide a cap construction which will conform to conventional forms of manufacture, be a simple construction and easy to use so as to provide a device that will be economically feasible, longlasting and relatively trouble free in operation.

A further object of the present invention is to provide a cap which may be utilized as a screw cap or a snap cap, or other type cap, which overcomes the deficiencies of the prior art.

Still a further object of the present invention is to provide an extension cap which will function independently of the nature of the liquid in the container.

Yet a further object of the present invention is the provision of an extension applicator utilizing a simple structure which is not subject to fouling or sticking because of the contents of the bottle.

Another object of the present invention is to provide an extended reach applicator with no delicate or mechanical parts.

These together with other objects and advantages shall be become subsequently apparent and reside in the details of construction and operation as more fully hereinafter described and claimed, reference being had to the accompanying drawings forming a part hereof wherein like numerals or further like parts throughout.

BRIEF DESCRIPTION OF THE DRAWING

FIG. 1 is a side view of the container and closure cap of the present invention;

FIG. 2 is a side view partially in section of the closure cap of the present invention;

FIG. 3 is a perspective view of another embodiment of a closure cap in accordance with the invention;

FIG. 4 is a side view of a further embodiment of the invention.

FIG. 5 is a side view of another embodiment of the bladder and diaphragm of the invention; and, FIG. 6 is a side view of a modified bladder portion of the invention.

DETAILED DESCRIPTION OF THE INVENTION

In FIG. 1, numeral 2 denotes a container for nail polish or other material as is well-known commercially. Container 2 has a threaded neck portion 16 which, as is also well-known, screw-threadedly engages corresponding screw threads in the cap to open, close, tighten and seal the liquid in the container. The screw threads in the cap is shown at reference numeral 14. Cap 8 has incorporated a shaft 6 to which is attached a brush 4.

Cap 8 has flexible portions such as 10 and 12 formed therein. As will be explained later, these flexible portions allow the user to access and squeeze a bladder located in the cap.

FIG. 2 is a side view partially in section of the cap portion 8 of FIG. 1. Again, a brush 4 in shaft 6 are shown. The shaft 6 is attached to flexible diaphragm 22. Diaphragm 22 is, in turn, coupled to the flexible bladder 18. Bladder 18 is affixed to the top end of cap 8 at 20 as by an appropriate adhesive. Shaft 6 is affixed similarly to flexible diaphragm 22 by adhesive at point 24.

Bladder 18 may be prefilled with inert gas or air and may also be formed of flexible plastic, which plastic returns to a predetermined position. In any event, squeezing the bladder 18 via flexible portions 10 and 12 compresses same, causing diaphragm 22 to expand thereby moving shaft 6 and brush 4 lengthwise away from the cap.

Other embodiments of caps incorporating the bladder concept for shaft extension are shown in FIGS. 3 and 4. As can be seen in FIG. 3, cap 8 has an aperture 5 at its top which allows for portion 3 of the bladder 18 to be exposed therethrough. This embodiment also shows the use of ridges 1 along the outer surface of cap 8 for more easily grasping the cap in any position, and providing a grip to tighten and remove the cap from the closure. Again, like reference numerals denote like parts so that portion 3 of bladder 18 allows the user to compress the bladder causing a diaphragm 22 to extend and thereby to correspondingly move the shaft 6 and the liquid pick-up means 4.

FIG. 4 shows still another embodiment of a cap incorporating the invention. In this embodiment a single aperture 9 is formed at the side of cap 8 allowing a portion 7 of the bladder to be reached by the user. Only a single aperture is required to be formed in the cap as the needed compression force is developed between the exposed portion 7 of bladder 18 and the opposite surface interior to cap 8 against which the compressive forces on bladder 18 react. This is a highly simplified design of a cap incorporating the present invention.

As will now be seen, one can extend shaft 6 and brush 4 into the bottle by simple squeezing through either the aperture of cap 8 or flexible portions thereof. So long as some pressure is maintained on the bladder 18, the brush will stay in its extended position. If a plastic is utilized to form the bladder, obviously, the rate of return of the plastic to its prior position before squeezing will determine for how long a period brush 4 and shaft 6 remain in the extended position. It is to be further noted that the degree of extension of shaft 6 and brush 4 is controlled by the dimensions of bladder 22.

The bladder/diaphragm combination, 18 and 22, shown as separate parts in FIGS. 2–4, may be formed as one integral unit as shown in FIG. 5. In FIG. 5, numeral 25, denotes the squeezable portion of the bladder, and numeral 26 shows the extendable diaphragm portion. As can be seen, the bladder/diaphragm are formed as an integral unit with the diaphragm folds 26 being configured at one end of the bladder 25. Thus, either the bladder/diaphragm may be two parts or, it may be formed as one single unit without departing from the scope or spirit of my invention. Two apertures 23 are formed in cap 8 permitting direct access to the bladder by the user.

If the two-piece structure of FIGS. 2–4 is utilized, then adhesive, in addition to a friction fit may be required to mount diaphragm 22 inside the cap.

FIG. 6 shows a bladder 18 which has a finger support 27 affixed to the bladder. Finger support 27 may be made of the same material as cap 8 and can be adhesively affixed to bladder 18. One or two of such supports can be used depending on whether the bladder can be touched at two portions (FIG. 5) or one portion (FIG. 4). The support aids the user in extending the brush.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. In a cap having a shaft and liquid pick-up means attached thereto, the improvement which comprises means for extending the length of said liquid pick-up means by moving the shaft relative to said cap, said improvement including sealed gas filled flexible means mounted within said cap and coupled to said shaft, said flexible means on compression thereof, causing said shaft to move relative to said cap.

2. A cap having a shaft and liquid pick-up means attached thereto, the iprovement which comprises means for extending the length of said liquid pick-up means by moving the shaft relative to said cap, the improvement including sealed gas filled flexible means mounted within said cap and coupled to said shaft, said cap having an aperture therein which permits a portion of said flexible means to be exposed.

3. The cap of claim 2 wherein said aperture is located at the top surface of the cap.

4. The cap of claim 2 wherein said aperture is located at the side of the cap.

5. The cap of claim 2 having means formed thereon for enabling the user to grip the cap, said gripping means comprising ridges formed at spaced intervals along a surface of said cap.

6. The cap of claim 2 wherein a finger support is affixed to said flexible means at said exposed portion.

7. A cap for reaching substantially completely to the bottom of the interior of an associated container, said cap including a cap body defining a first downwardly opening recess therein for receiving a container neck, an elongated dispenser shank including liquid pick-up means on its lower end, and mounting means mounting the upper end of said dispenser shank in said cap, the improvement comprising: a sealed flexible gas filled bladder mounted within said recess and connected to said shank for increasing the reach of said liquid pick-up means when said bladder is compressed.

8. The cap of claim 7, wherein said cap body has at least a first aperture therein, whereby a portion of said bladder is exposed through said aperture.

9. The cap of claim 7, wherein said flexible bladder is affixed within said recess to prevent removal thereof.

10. A cap and dispenser combination for reaching substantially completely to the bottom of the interior of an associated container, said combination including: a cap body defining the first downwardly opening recess therein for receiving a container neck, a sealed flexible gas filled bladder contained in said recess, a diaphragm portion formed integrally with said bladder, a shaft connected to said diaphragm portion, and liquid pick-up means connected to said shaft.

11. A dispensing apparatus for fingernail enamel and the like, said apparatus comprising a container for holding said enamel and having a neck portion with an open top, enclosure means for said container cooperatively engageable with the neck portion thereof, a combination which comprises applicator means having a sealed flexible gas filled diaphragm formed therein, means to expose a portion of said diaphragm for compression thereof; a shaft connected to said diaphragm and liquid pick-up means connected to said shaft whereby said shaft is moved on compression of said diaphragm.

* * * * *